US005918907A

United States Patent [19]

Ho

[11] Patent Number: 5,918,907

[45] Date of Patent: Jul. 6, 1999

[54] COMPACT READING APPARATUS

[76] Inventor: Cheng-Cheng Ho, 1 Fl., No. 145, HanCheng St., Taichung, Taiwan

[21] Appl. No.: 08/907,525

[22] Filed: Aug. 8, 1997

[51] Int. Cl.[6] ..... B42D 3/00

[52] U.S. Cl. ..... 281/45; 248/441.1; 248/445; 248/455; D19/91

[58] Field of Search ..... 281/42, 43, 44, 281/45, 455; 248/454, 453, 460, 456, 441.1, 445; D19/91

[56] References Cited

U.S. PATENT DOCUMENTS

| | | | |
|---|---|---|---|
| 34,353 | 4/1862 | Daniels | D19/91 |
| 3,952,989 | 4/1976 | Hatcher | D19/91 |
| 4,460,146 | 7/1984 | Raggiotti | 248/456 |
| 5,251,935 | 10/1993 | Bottiglieri | 281/45 |

*Primary Examiner*—Frances Han
*Assistant Examiner*—Monica Smith
*Attorney, Agent, or Firm*—W. Wayne Liauh

[57] ABSTRACT

A reading apparatus capable to support a book with adjustable angle includes: a base having a guiding groove and two sleeves, a supporting mechanism for supporting the book, and a clamping member for clamping the book on the supporting mechanism. The supporting mechanism includes a M-shaped frame defining two side rods, an elongated middle rod and an adjusting plate. The two side bars of the M-shaped frame are pivotally connected to the sleeves respectively. The middle rod is connected at middle of the M-shaped frame at one end thereof and is parallel to the two side bars. The adjusting plate is slidably and rotatably engaged with the middle rod and is formed with an oblique edge which can be received by the guiding groove at an adjustable position. The clamping member is pivoted to the front edge of the base for providing a clamping force facing the M-shaped frame. By adjusting the position of the adjusting plate along the guiding groove, the angle between the M-shaped frame and the base can be changed. Therefore user can easily adjust the supporting angle of book for reading under any desired condition. When the compact reading apparatus is not in use, the clamping member, adjusting plate and the M-shaped frame can be readily pivoted to flush with the base such that the volume of the reading apparatus can be minimized.

7 Claims, 8 Drawing Sheets

COMPACT READING APPARATUS

BACKGROUND OF THE INVENTION

1. Field of the Invention

This invention relates to a compact reading apparatus, and more particularly, to a compact reading apparatus which is capable to hold a printed publication such as a book or magazine at an adjustable angle for facilitating reading of the printed publication.

2. Background of the Invention

Conventional reading device for holding a printed publication such as a book or magazine has been limited to support the printed publication at a fixed angle since the book supporting mechanism of conventional reading device is usually fixed and thus is incapable to adjust the supporting angle of the book. However, since the height, sitting posture and reading habit of different people may be various, and the light source condition may change from time to time, therefore the conventional reading device providing fixed reading angle can not anymore satisfy the need of various reading conditions. In addition, the fixed supporting mechanism of conventional reading device is also resulting the drawback of having relatively large volume and hence occupies more space when transporting or displaying in a store. Furthermore, conventional reading device with a large size is also inconvenient for a user to store when not in use. Although some reading devices with adjustable book supporting mechanism have been developed during the recent years, however, they all have the same deficiencies of being high cost, complex in structure and difficult to manipulate, and thus leave a room for further improvement.

SUMMARY OF THE INVENTION

In view of the aforesaid limitations of conventional reading device, it is therefore an object of the present invention to provide a reading apparatus which is capable to support a book with adjustable angle such that a user can readily and easily adjust the supporting angle of book for facilitating reading under a desirable condition. In addition, the reading apparatus has a book supporting mechanism which is capable to be folded to flush with a base of the reading apparatus when not in use such that the volume of the reading apparatus can be minimized. The reading apparatus has generally a very simple structure and is compact in size and thus can be manufactured, transported and stored with relatively low cost as well as space saving.

Another object of the present invention is to provide a compact reading apparatus capable to hold a printed publication, such like a book, at an adjustable angle. The compact reading apparatus comprises: a base, a supporting mechanism for supporting the book, and a clamping member for clamping the book firmly on the supporting mechanism. The base is defined with a front edge, a front portion and a rear portion. The base is also finished with a guiding groove formed on the rear portion and a pair of spaced apart sleeves furnished at a location between the front and rear portions. The supporting mechanism includes a M-shaped frame, a middle rod, a bottom rod and an adjusting plate. The M-shaped frame has two side rods pivotally connected to the sleeves. The bottom rod is pivotally connected between the two sleeves. The middle rod is connected at middle of the M-shaped frame at one end thereof while having the other end connected at middle of the bottom rod. The adjusting plate is slidably engaged with the middle rod and is slidable along and rotatable about the middle rod. The adjusting plate is formed with an oblique edge which can be received by the coordinated guiding groove at an adjustable position so as to perform a means for determining the angle between the M-shaped frame and the base. The clamping member is pivoted to the front edge of the base for providing a clamping force facing the M-shaped frame such that a book can be positioned and clamped firmly between the clamping member and the M-shaped frame for facilitating reading. By adjusting the position of the adjusting plate along the guiding groove, the angle between the M-shaped frame and the base can be changed. Therefore user can easily adjust the supporting angle of book for reading under any desired condition. When the compact reading apparatus is not in use, the clamping member, adjusting plate and the M-shaped frame can be readily pivoted to flush with the base such that the volume of the reading apparatus can be minimized for transportation and storage.

BRIEF DESCRIPTION OF THE DRAWINGS

The foregoing features of the present invention may be more fully understood from the following detailed description, read in conjunction with the accompanying drawings, wherein.

DESCRIPTION OF THE PREFERRED EMBODIMENT

Figure 1:
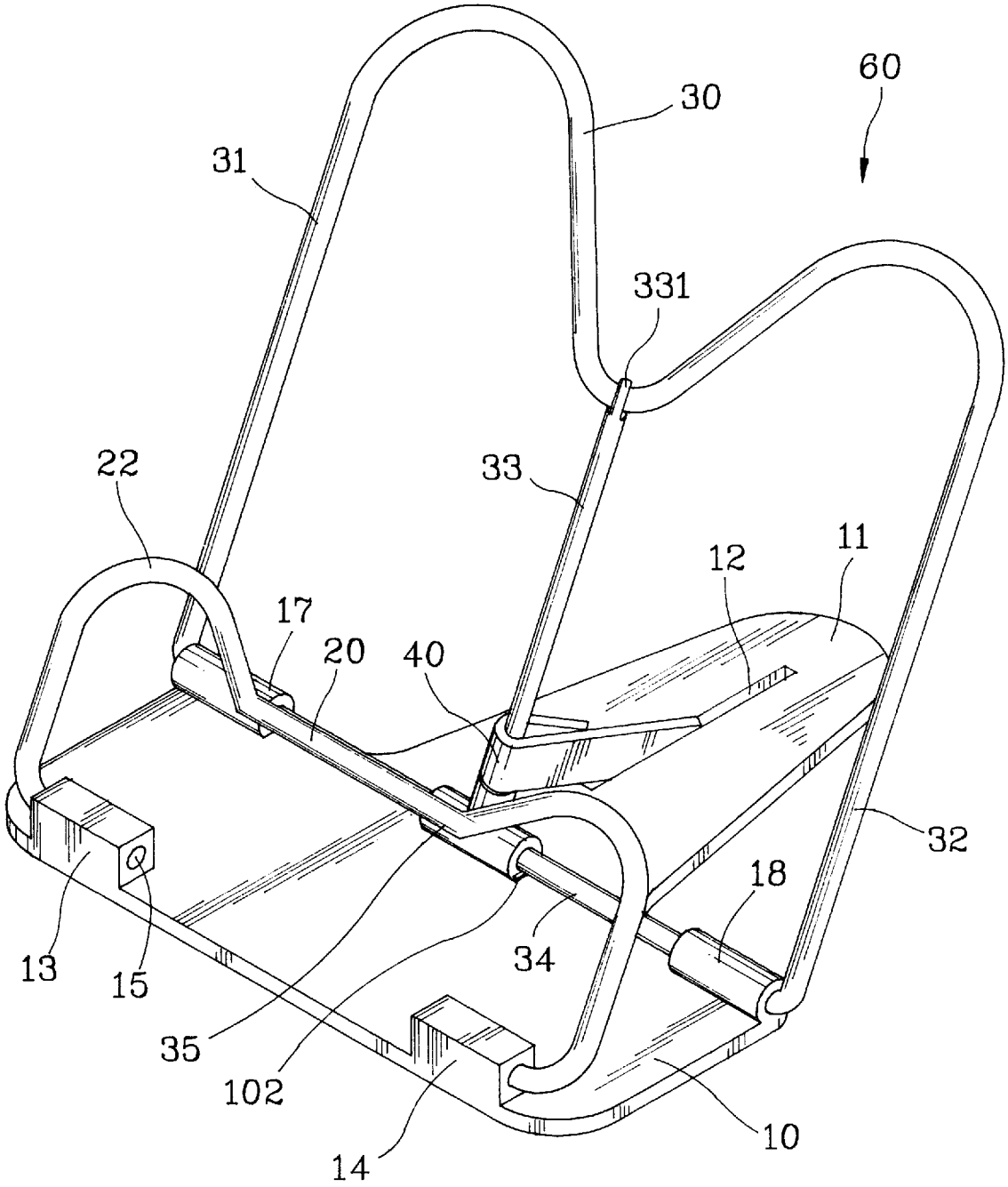
FIG. 1 is a perspective view of a compact reading apparatus in accordance with a preferred embodiment of the present invention.
Figure 2:
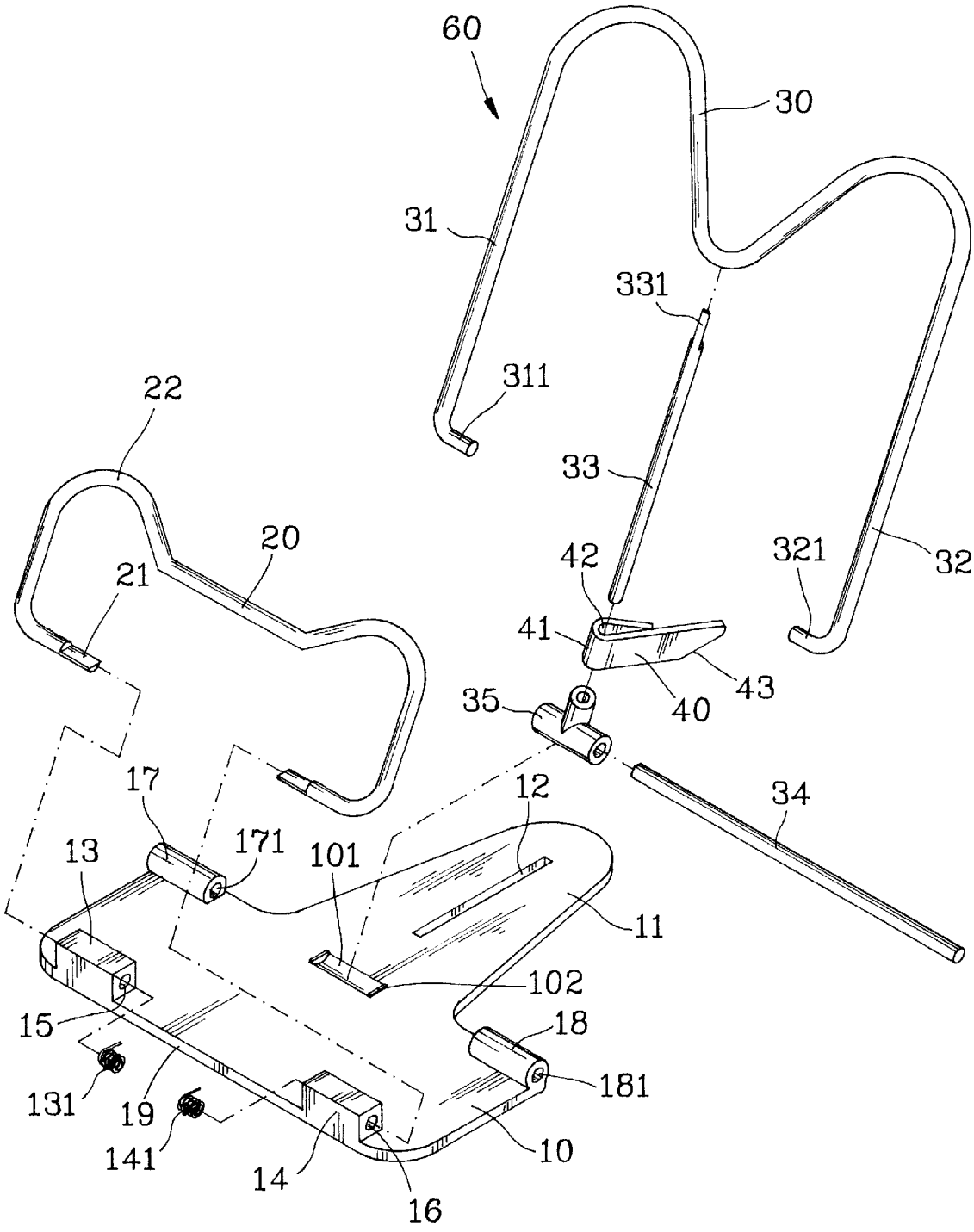
FIG. 2 is an exploded view of the compact reading apparatus shown in FIG. 1.

Referring to FIG. 1 and 2, a preferred embodiment of the compact reading apparatus of the present invention is shown. The compact reading apparatus generally comprises: a supporting mechanism 60 for supporting a book (not shown in the figures), a clamping member 20 for clamping the book firmly on the supporting mechanism 60 and a base 10 for locating the supporting mechanism 60 and the clamping member 20.

The base 10 is made of a platelike hard material defining a front edge 19 and an extended rear portion 11 thereon and is furnished with a guiding groove 12, a pair of spaced apart sleeves 17,18, a pair of spaced apart positioning blocks 13,14, and a concave 101. The guiding groove 12 is elongated and is formed at a middle part of the rear portion 11 along a direction perpendicular to the front edge 19. The two sleeves 17,18 are furnished between the front edge 19 and the rear portion 11, wherein each of the two sleeves 17,18 has respectively a through hole 171,181 defined therein. The positioning blocks 13,14 are located at a position adjacent to the front edge 19 and each of the two positioning blocks 13,14 has respectively a through hole 15,16 formed therein. Two springs 131,141 (torsion springs preferred) are respectively furnished within the two holes 15,16 of the positioning blocks 13,14. The concave 101 is formed on the base 10 at a middle location between the two sleeves 17,18 and is formed with two bulge 102 at two sides of the concave 101.

Figure 3:
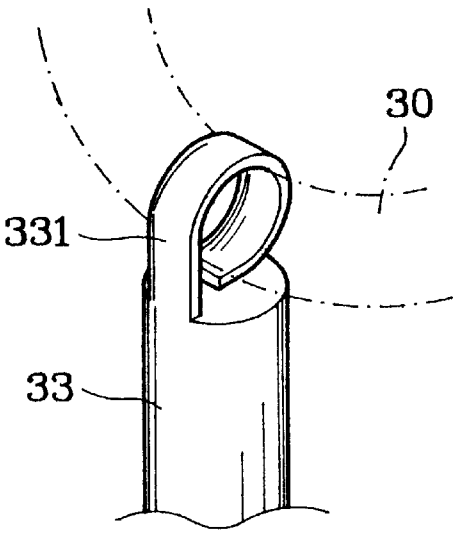
FIG. 3 is a partially enlarged view illustrating the elongated flat portion of the middle rod of the compact reading apparatus.

The supporting mechanism 60 comprises: a M-shaped frame 30, an elongated middle rod 33, a bottom rod 34, a three-way connecting member 35 and an adjusting plate 40. The M-shaped frame 30 has two side rods 31,32 which are parallel to each other and are pivotally connected to the two holes 171,181 of the sleeves 17,18 respectively at two lower ends 311,321 thereof. The three-way connecting member 35 is substantially T-shaped defining a through hole and a mid-hole intercommunicating with the through hole. The bottom rod 34 is elongated and is received by the through hole of the three-way connecting member 35 at middle of the bottom rod 34 while having two ends thereof pivotally connected to the two holes 171,181 of the sleeves l7,18 respectively, in the mean time, the three-way connecting member 35 is right rotatably mounted on the concave 101. Therefore, the three-way connecting member 35 is rotatable about the holes 171,181 of the sleeves 17,18 but is not movable along the bottom rod 34 since the two opposite ends of the three-way connecting member 35 are limited by the bulges 102. One end of the elongated middle rod 33 is connected to the mid-hole of the three-way connecting member 35. The other end of the middle rod 33 is formed with an elongated flat portion 331 which is made by cutting off part of the material of the middle rod 33. By folding up the elongated flat portion 331 to form a substantially round hole (as shown in FIG. 3), the M-shaped frame 30 can be received by the round hole formed at the elongated flat portion 331, such that the middle rod 33 can be connected to the middle of the M-shaped frame 30, as which shown in FIG. 1. The adjusting plate 40 is substantially an elongated thin plate having one end thereof formed with an oblique edge 43. By folding up the elongated adjusting plate 40 about a folded portion 41, a through hole 42 is formed adjacent to the folded portion 41. The middle rod 33 can then be received by the through hole 42 of the adjusting plate 40 such that the adjusting plate 40 is movable along and pivotal about the middle rod 33. The oblique edge 43 of the adjusting plate 40 is coordinated with the guiding groove 12 of the base 10 and can be received by the guiding groove 12 at any desirable position so as to perform a means for adjusting the angle between the M-shaped frame 30 and the base 10.

Figure 4:
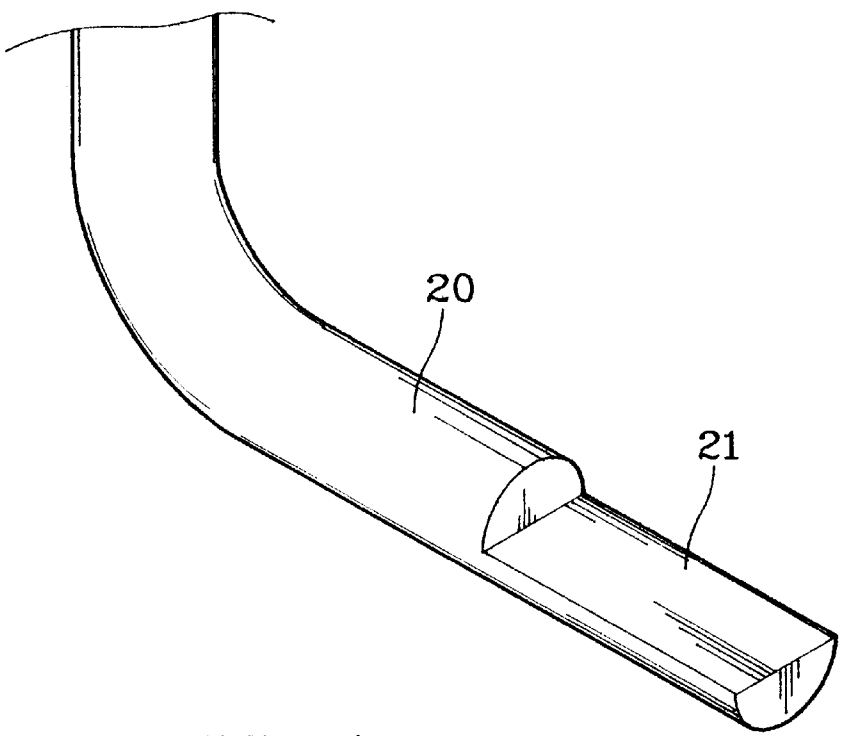
FIG. 4 is a partially enlarged view illustrating the wedging end of the C-shaped clamping member of the compact reading apparatus.

The clamping member 20 is substantially a C-shaped rod having two wedging ends 21 formed by cutting off part of the material of the clamping member 20 at two ends thereof as shown in FIG. 4. The two wedging ends 21 are respectively pivoted to the two holes 15,16 of the positioning blocks 13,14 and are engaged with the torsion springs 131,141 in such a manner that the springs 131,141 provide a force driving the clamping member 20 to pivot about the positioning blocks 13,14 toward a direction facing the M-shaped frame 30.

Figure 5:
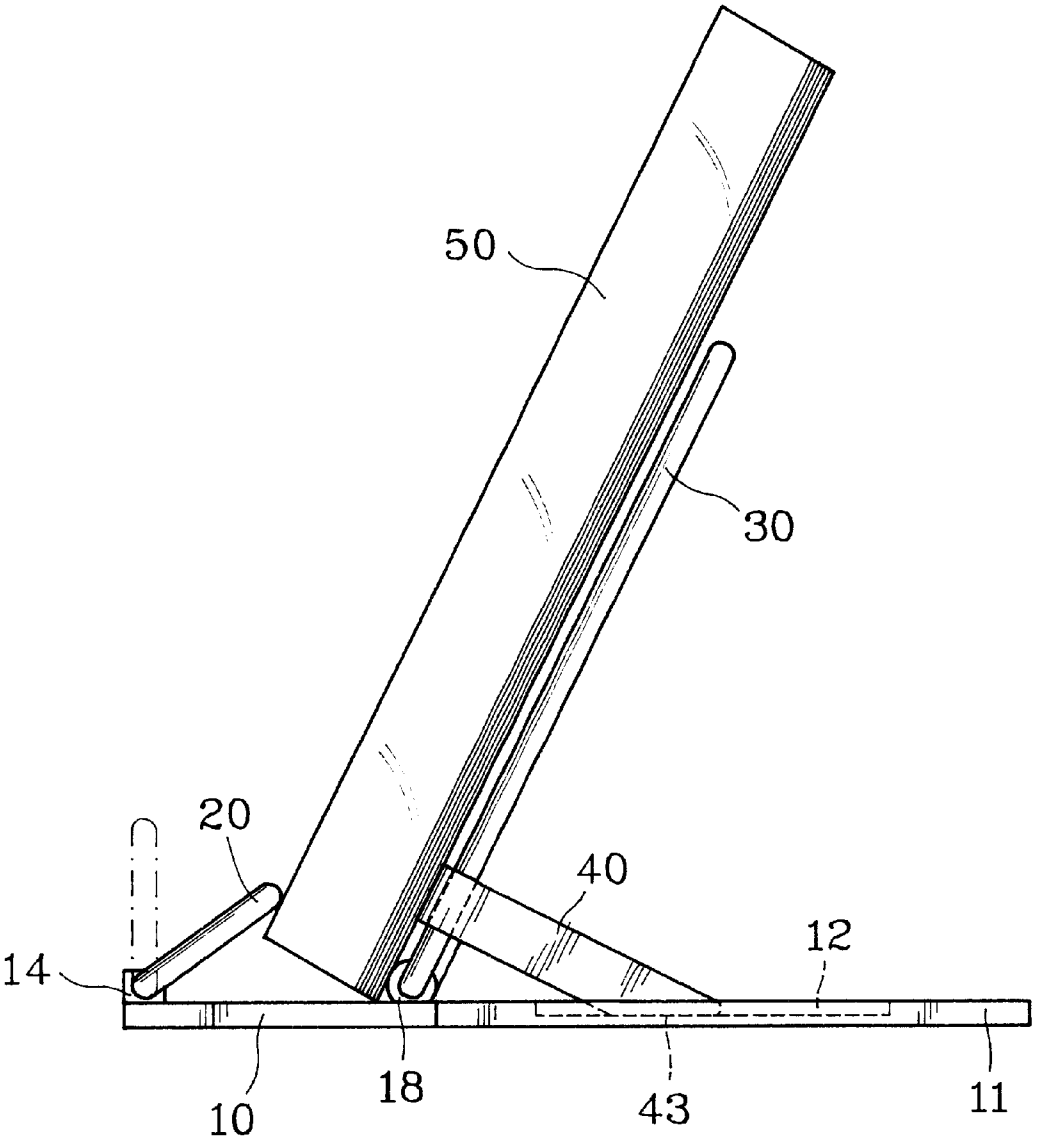
FIG. 5 is a schematic view of the compact reading apparatus representing a book being positioned on the M-shaped frame and being clamped by the clamping member.
Figure 8:
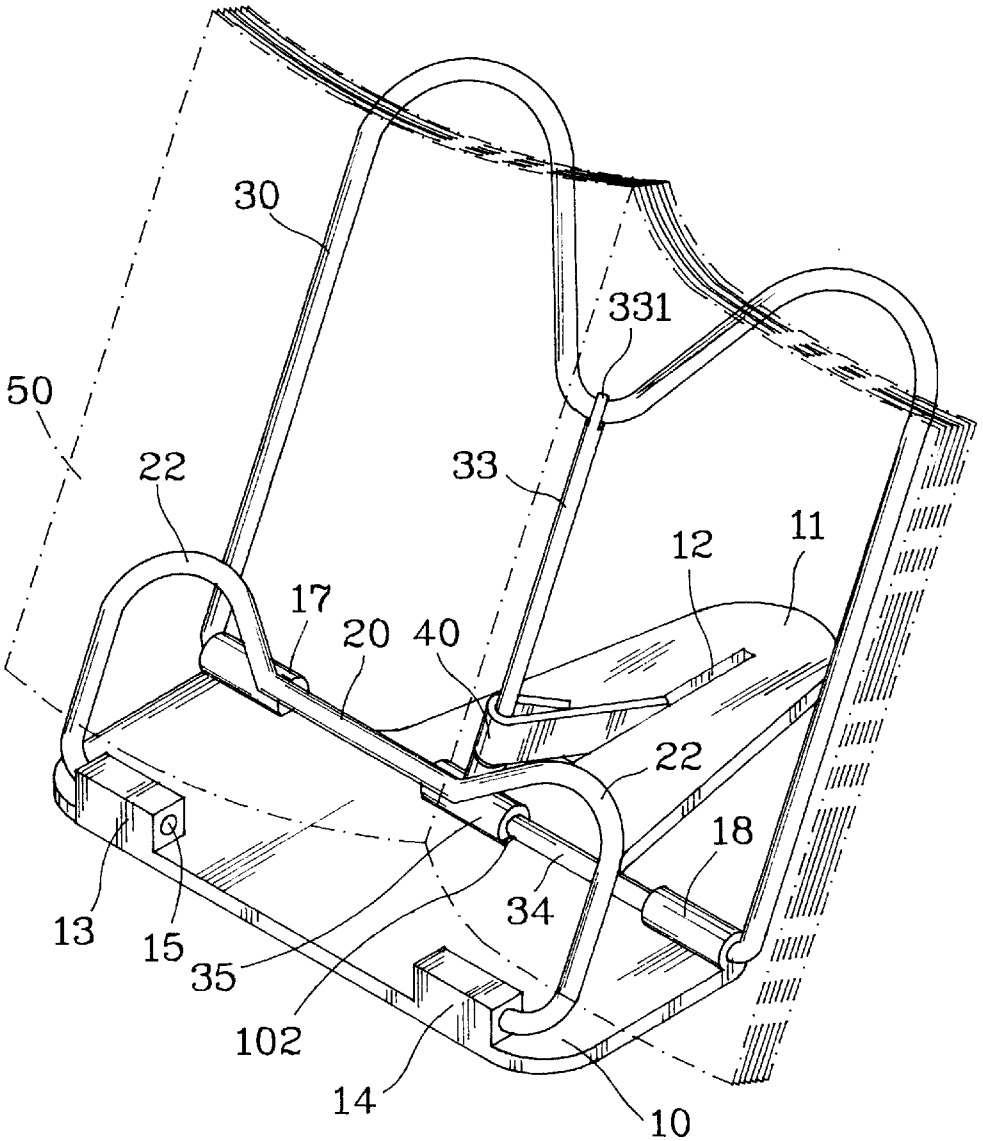
FIG. 8 is a perspective view of the compact reading apparatus of the present invention in use state (with a book supported thereon).

Referring to FIG. 5, in conjunction with FIG. 8, a printed publication such like a book 50 can be supported by the M-shaped frame 30 while having the book 50 open for reading by a user (not shown in figures). The springs 131,141 furnished within the positioning blocks 13,14 provide a force driving the clamping member 20 to clamp the book 50 such that the book 50 can be held firmly between the M-shaped frame 30 and the clamping member 20. Horn-like portions 22 can also be formed on the clamping member 20 for facilitating manipulation as well as improving clamping effect. The oblique edge 43 of the adjusting plate 40 is received and supported by the coordinated guiding groove 12 such that the M-shaped frame 30 is capable to support the book 50 securely.

Figure 6:
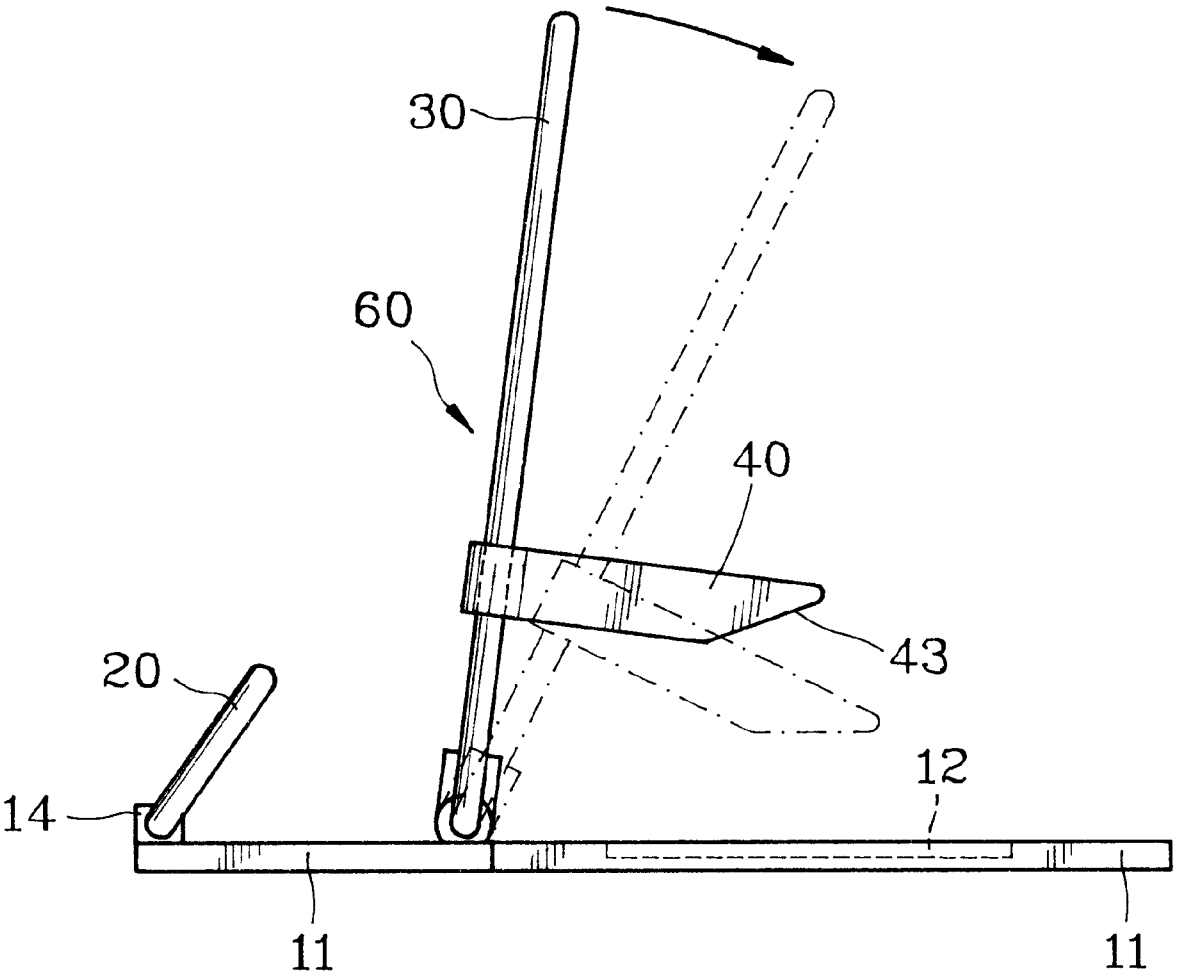
FIG. 6 and 7 schematically illustrate the consequent processes for adjusting the book supporting angle of the M-shaped frame of the compact reading apparatus.
Figure 7:
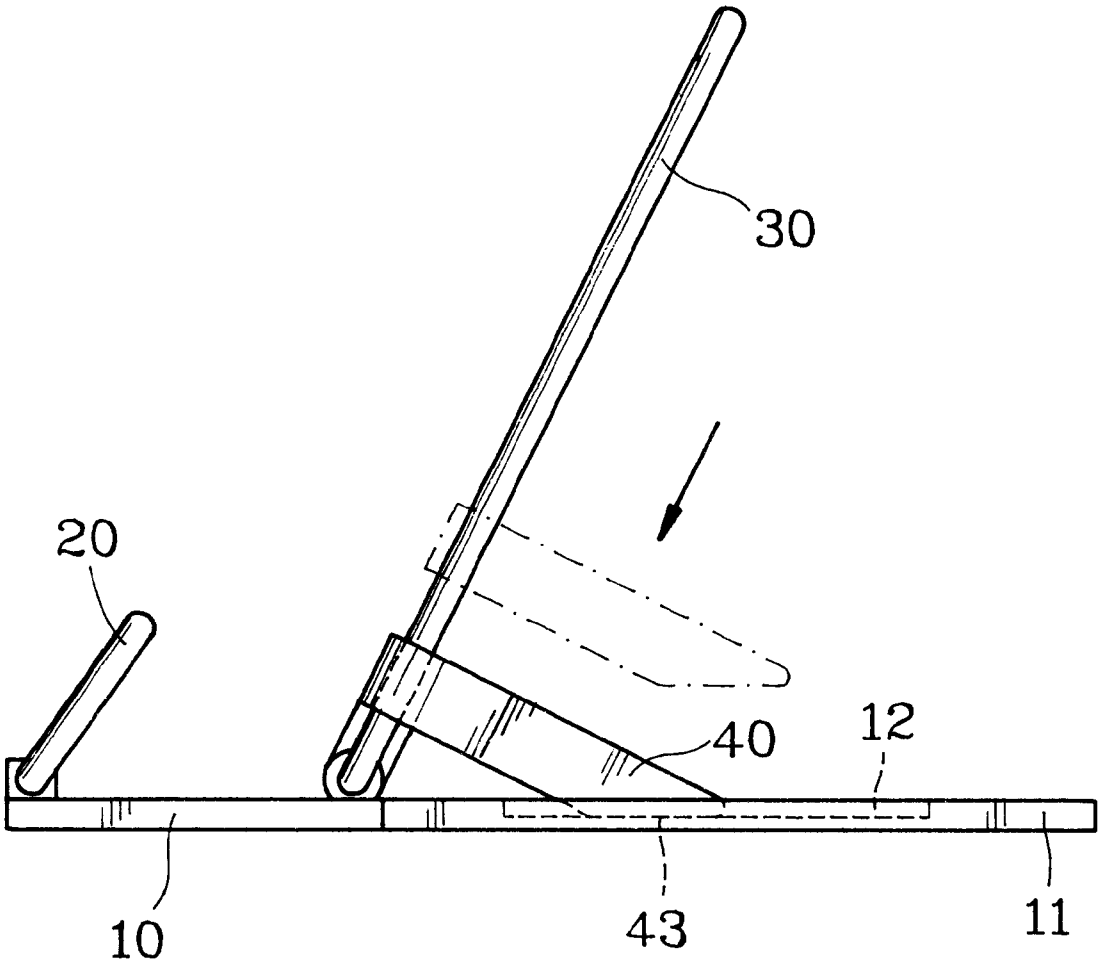

Referring to FIG. 6 and 7, which schematically illustrate the consequent processes for adjusting the book supporting angle of the M-shaped frame 30 of the compact reading apparatus of the present invention. When a user wants to change the angle between the M-shaped frame 30 and the base 10, he/she can firstly lift up the adjusting plate 40 along the middle rod 33, adjusts the M-shaped frame 30 to a desirable position (as shown in FIG. 6), and then slides the adjusting plate 40 down along the middle rod 33 until the oblique edge 43 of the adjusting plate 40 is firmly received by the guiding groove 12 of the base 10. Such that the user can readily and easily adjust the supporting angle of the book for facilitating reading under any desirable condition.

Figure 9:
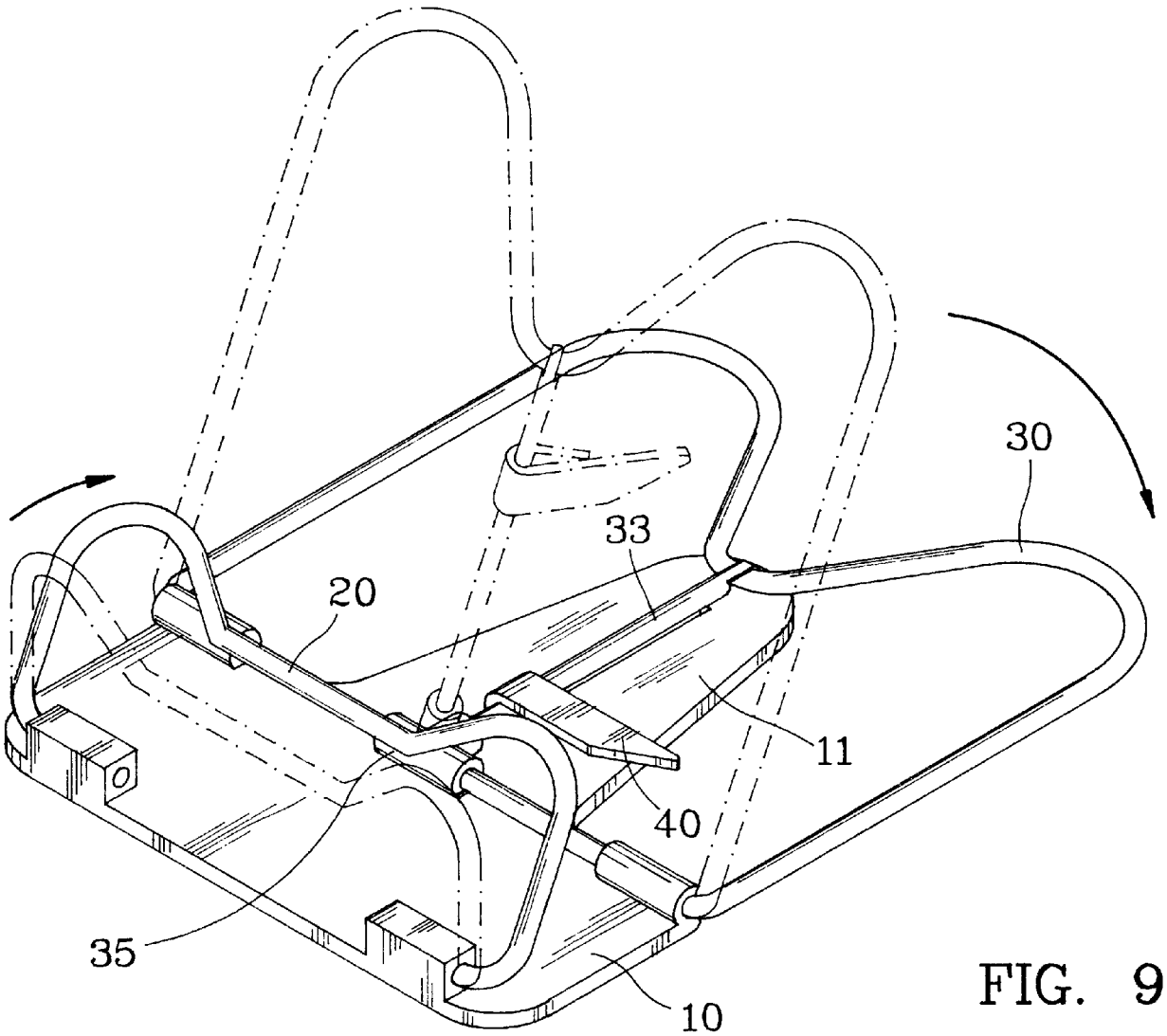
FIG. 9 schematically illustrates the clamping member, adjusting plate and the M-shaped frame being pivoted to flush with the base in order to minimize the volume of the compact reading apparatus.

Referring to FIG. 9, when the compact reading apparatus is not in use, the adjusting plate 40, the clamping member 20 and the M-shaped frame 30 can be readily pivoted to flush with (lie on) the base 10 such that the volume of the compact reading apparatus can be minimized for transportation and storage. Furthermore, since the overall structure of the compact reading apparatus is very simple, furthermore, the use of the three-way connecting member 35 and the elongated flat portion 331 of the middle rod 33 makes the supporting mechanism 60 very easy to be manufactured and assembled, therefore, the cost of the compact reading apparatus is relatively low.

Although certain specific embodiment of the present invention has been shown and described above, it is to be understood that many modification thereof are possible. The present invention, therefore, is not to be restricted except insofar as is necessitated by the prior art and by the spirit of the appended claims.

I claim:

1. A compact reading apparatus capable to hold a printed publication at an adjustable angle, said compact reading apparatus comprising:

a base defining a front edge and a rear portion thereof, said base having a guiding groove, a pair of spaced apart sleeves and a pair of spaced apart positioning blocks, said guiding groove being elongated and being formed at middle of said rear portion along a direction perpendicular to said front edge, said two sleeves being furnished at a location between said front edge and said rear portion, said positioning blocks being located at the front edge;

a supporting mechanism for supporting said printed publication, said supporting mechanism comprising a M-shaped frame, a middle rod, a bottom rod and an adjusting plate, said M-shaped frame having two side rods parallel to each other, said side rods being pivotally connected to said sleeves, said bottom rod being pivotally connected between said two sleeves, said middle rod being elongated and extending along a direction parallel to said side rods and having one end thereof connected at middle of said M-shaped frame while having the other end of the middle rod connected at middle of said bottom rod, said adjusting plate having one edge thereof slidably connected with said middle rod while having another opposite edge formed with an oblique edge which is receivable by said guiding groove at an adjustable position of said guiding groove so as to perform a means for adjusting an angle between said M-shaped frame and said base; and a substantially C-shaped clamping member having two wedging ends pivoted to said two positioning blocks respectively, two springs being respectively furnished within said two positioning blocks and being engaged with said wedging ends for providing a force driving said clamping member to pivot about said positioning blocks toward a direction facing said M-shaped frame.

2. The compact reading apparatus of claim 1, wherein said middle rod has an elongated flat portion formed at one end thereof and is connected to said M-shaped frame by means of folding said elongated flat portion to form a substantially round hole for receiving the middle of the M-shaped frame.

3. The compact reading apparatus of claim 1, wherein said adjusting plate is elongated and is slidably connected with said middle rod by means of folding said elongated adjusting plate about a folded portion so as to form a substantially through hole adjacent to said folded portion for receiving said middle rod slidably and pivotally.

4. The compact reading apparatus of claim 1, wherein said rear portion is an extended portion.

5. The compact reading apparatus of claim 1 further comprising a T-shaped three-way connecting member defining a through hole and a mid-hole intercommunicating with said through hole, said bottom rod being received by said through hole at middle thereof while one end of said middle rod being received by said mid-hole such that one end of the middle rod is substantially connected at middle of the bottom rod.

6. The compact reading apparatus of claim 5, wherein a concave is formed on said base for receiving said three-way connecting member in a rotatable manner.

7. The compact reading apparatus of claim 6, wherein said concave has two bulges formed at two ends thereof for limiting said three-way connecting member from sliding along said bottom rod.

* * * * *